US010633607B2

(12) United States Patent
Greaves et al.

(10) Patent No.: US 10,633,607 B2
(45) Date of Patent: Apr. 28, 2020

(54) LUBRICANT WITH SULFUR-CONTAINING POLYALKYLENE GLYCOL

(71) Applicant: Dow Global Technologies LLC, Midland, MI (US)

(72) Inventors: Martin R. Greaves, Baar (CH); Ronald Van Voorst, Vogelwaarde (NL); Marinus Meertens, Tilburg (NL)

(73) Assignee: Dow Global Technologies LLC, Midland, MI (US)

( * ) Notice: Subject to any disclaimer, the term of this patent is extended or adjusted under 35 U.S.C. 154(b) by 164 days.

(21) Appl. No.: 15/753,377

(22) PCT Filed: Aug. 17, 2016

(86) PCT No.: PCT/US2016/047273

§ 371 (c)(1),
(2) Date: Feb. 19, 2018

(87) PCT Pub. No.: WO2017/031162

PCT Pub. Date: Feb. 23, 2017

(65) Prior Publication Data

US 2018/0237714 A1 Aug. 23, 2018

Related U.S. Application Data

(60) Provisional application No. 62/207,397, filed on Aug. 20, 2015.

(51) Int. Cl.

| | |
|---|---|
| ***C10M 105/72*** | (2006.01) |
| ***C10M 169/04*** | (2006.01) |
| ***C10M 107/46*** | (2006.01) |
| ***C10M 133/12*** | (2006.01) |
| ***C10M 135/36*** | (2006.01) |

(52) U.S. Cl.

CPC ..... *C10M 105/72* (2013.01); *C10M 107/46* (2013.01); *C10M 133/12* (2013.01); *C10M 135/36* (2013.01); *C10M 169/04* (2013.01); *C10M 2209/105* (2013.01); *C10M 2209/107* (2013.01); *C10M 2209/108* (2013.01); *C10M 2215/064* (2013.01); *C10M 2215/065* (2013.01); *C10M 2219/066* (2013.01); *C10M 2219/082* (2013.01); *C10M 2219/084* (2013.01); *C10M 2219/087* (2013.01); *C10M 2219/108* (2013.01); *C10M 2221/043* (2013.01); *C10N 2230/10* (2013.01); *C10N 2230/12* (2013.01); *C10N 2230/40* (2013.01); *C10N 2240/08* (2013.01); *C10N 2240/12* (2013.01); *C10N 2240/121* (2013.01)

(58) Field of Classification Search
None
See application file for complete search history.

(56) References Cited

U.S. PATENT DOCUMENTS

| | | | |
|---|---|---|---|
| 2,455,117 A | 11/1948 | Glavis et al. | |
| 3,005,853 A | 10/1961 | Wilgus et al. | |
| 3,135,804 A | 6/1964 | Von Brachel et al. | |
| 4,606,833 A | 8/1986 | Schuettenberg et al. | |
| 5,308,512 A | 5/1994 | Stoll et al. | |
| 6,127,324 A | 10/2000 | Tolfa et al. | |
| 8,901,060 B2 | 12/2014 | Fasbender et al. | |
| 2013/0157909 A1* | 6/2013 | Greaves | C10M 169/04 508/282 |

FOREIGN PATENT DOCUMENTS

| | | |
|---|---|---|
| WO | 2004053031 | 6/2004 |

OTHER PUBLICATIONS

International Search Report & Written Opinion for related PCT Application PCT/US2016/047273, dated Oct. 31, 2016 (12 pgs).
The Dow Chemical Company; "UCON OSP Base Fluids: A Breakthrough in oil-soluble PAG base fluid technology" (Feb. 28, 2011) (4 pgs).
International Preliminary Report on Patentability for related PCT Application PCT/US2016/047273, dated Mar. 1, 2018 (7 pgs).

* cited by examiner

*Primary Examiner* — Vishal V Vasisth
(74) *Attorney, Agent, or Firm* — Brooks, Cameron & Huebsch, PLLC

(57) ABSTRACT

A fluid contains a base oil and an antioxidant, the base oil consisting of sulfur-containing polyalkylene glycol where greater than 80 weight-percent of the fluid is a sulfur-containing polyalkylene glycol and less than one weight-percent of the fluid is water, with weight percent based on total fluid weight an wherein the sulfur-containing polyalkylene glycol is free of oxygen bound directly to sulfur.

8 Claims, No Drawings

LUBRICANT WITH SULFUR-CONTAINING POLYALKYLENE GLYCOL

This application is a National Stage Application under 35 U.S.C. § 371 of International Application Number PCT/US2016/047273, filed Aug. 17, 2016 and published as WO 2017/031162 on Feb. 23, 2017, which claims the benefit to U.S. Provisional Application 62/207,397, filed Aug. 20, 2015, the entire contents of which are incorporated herein by reference in its entirety.

BACKGROUND OF THE INVENTION

Field of the Invention

The present invention relates to a fluid containing a sulfur-containing polyalkylene glycol base oil and an antioxidant.

Introduction

Industrial fluids that are fire resistant, and particularly those that have thermo-oxidative stability, are desirable for high temperature applications such as lubricants and hydraulic fluids in steel processing and power generation. It is a continuous desire and challenge to increase the fire resistance and thermo-oxidative stability of such industrial fluids. Hydrocarbon oils, which are historically used as lubricants, are generally undesirable in such applications because of their combustible nature. Water-based lubricants offer better fire resistant properties than hydrocarbon oils but tend to be unsuitable for use in high temperature applications where water can evaporate. Anhydrous lubricants are typically needed for high temperature applications.

le;.5qConventional polyalkylene glycols (PAGs) are known as lubricant base oil alternatives to hydrocarbons and water. Conventional PAGs are PAGs that are initiated using a monol, diol or triol and reacted with ethylene oxide and/or propylene oxide to form polymers which typically have molecular weights greater than 500 g/mol and up to 50,000 g/mol. Lubricant compositions using such conventional PAGs as base oils offer favorable performance benefits as hydraulic fluids and turbine oils. Yet, conventional PAGs tend to suffer from oxidative instability unless an antioxidant is present. Therefore, as antioxidant depletes from a conventional PAG based lubricant composition the oxidative stability of the lubricant suffers undesirably.

It is desirable to identify an industrial fluid that offers fire resistant properties and thermo-oxidative stability while also offering lubricating capabilities of a PAG, especially if the performance of the lubricant base oil exceeds that of conventional PAGs so the oxidative stability of the fluid is less dependent on the amount of antioxidant present.

BRIEF SUMMARY OF THE INVENTION

The present invention offers a fluid with surprisingly high fire resistant properties and thermo-oxidative stability while also offering lubricating capabilities of a PAG. The base oil of the inventive lubricant tends to have higher fire resistance properties and/or thermo-oxidative stability than conventional PAGs.

In a first aspect, the present invention is a fluid comprising a base oil and an antioxidant, the base oil consisting of a sulfur-containing polyalkylene glycol where greater than 80 weight-percent of the fluid is a sulfur-containing polyalkylene glycol and less than one weight-percent of the fluid is water, with weight percent based on total fluid weight and wherein the sulfur-containing polyalkylene glycol is free of oxygen bound directly to sulfur.

In a second aspect, the present invention is a method for using the fluid of the first aspect, the method comprising introducing the fluid of any previous claim into an apparatus as a material selected from a group consisting of hydraulic fluid and lubricating fluid.

The fluid of the present invention is useful as lubricants and hydraulic fluids, especially for use in high temperature and high pressure applications where aqueous lubricants are undesirable.

DETAILED DESCRIPTION OF THE INVENTION

"And/or" means "and, or alternatively". All ranges include endpoints unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

Determine kinematic viscosity according to ASTM D7042. Calculate viscosity index for a lubricant formulation according to ASTM D2270. Determine pour point according to ASTM D97. Measure hydroxyl number according to ASTM D4274. Determine fire point values according to ASTM method D92.

The present invention is a fluid comprising a base oil and an antioxidant. The fluid is desirable as a hydraulic fluid and/or lubricant fluid. The fluid is particularly desirable due to its flame retardancy.

The base oil of the present invention is a sulfur-containing polyalkylene glycol (S-PAG) that is free of oxygen bound directly to sulfur. Desirably, the S-PAG comprises copolymerized propylene oxide, butylene oxide or a combination of both copolymerized propylene oxide and butylene oxide. Additionally, or alternatively, the S-PAG can be free of more than two, preferably free of more than one and can be completely free of copolymerized ethylene oxide. Desirably, the S-PAG is free of —$C_2H_4O$— components resulting from polymerization of ethylene oxide. For example, —$C_2H_4O$— originating from an alcohol initiator (for example, butanol or thiodiglycol) does not contribute a —$C_2H_4O$— component resulting from polymerization of ethylene oxide to the resulting S-PAG. For instance, the S-PAG can be free of —$C_2H_4O$— groups that are not bound directly to sulfur.

The S-PAG can have the structure of Structure (I):

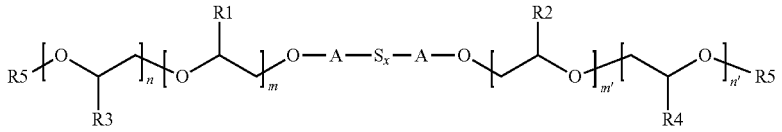

(I)

where R1, R2, R3 and R4 are independently selected from a group consisting of methyl (—$CH_3$) and ethyl (—$CH_2CH_3$) groups; R5 is selected from a group consisting of hydrogen, aliphatic groups containing from one to six carbons and aromatic groups containing six carbons; x is a number selected from a group consisting of 1 and 2; m, m', n, and n' are independently selected from a number in a range of zero to twenty such that the sum of m, m', n and n' is at least six and A is selected from a group consisting of —$C_2H_4$— and $C_6H_4$ groups. One particularly desirably S-PAG has the structure of Structure (I) where x is one and A is —$C_2H_4$—. In addition or as an alternative to any combination of these options for Structure (I), R1, R2, R3 and R4 can all be —$CH_3$ groups. When m, n, m' and n' are each one or more then the polymer is a random or block copolymer. A random copolymer occurs when the reactive oxides are simultaneously added to the initiator. As the polymer grows the oxides randomly add to the polymer backbone creating a final random copolymer. A block structure occurs when one oxide is added to the initiator and when this has fully reacted then a second oxide is added. The final structure is described as a block structure since it contains blocks of oxides therein.

The fluid contains greater than 80 weight-percent (wt %), preferably 85 wt % or more, more preferably 90 wt % or more, and can be 95 wt % or more of the S-PAG base oil, with wt % relative to total fluid weight.

The antioxidant of the present invention can be selected from a group consisting of free radical scavengers, peroxide decomposers and phenolic antioxidants. Examples of free radical scavengers include aromatic based aminic antioxidants such as alkylated diphenylamines and phenyl-alpha-naphthylamine and alkylated phenyl-alpha-naphthylamines Peroxide decomposer antioxidants include carbamate type anti-oxidants such as alkylated dithiocarbamates. Free radical scavengers are desirable as antioxidants, especially aminic types. One particularly desirable antioxidant is octylated/butylated diphenylamine The antioxidant is desirably present at a concentration of 0.25 wt % or more, preferably 0.5 wt % or more and at the same time five wt % or less, preferably two wt % or less with wt % based on total fluid weight.

Less than one wt % of the fluid is water, with wt %. Preferably the fluid contains 0.5 wt % or less, more preferably 0.1 wt % or less, more preferably 0.05 wt % or less and can contain 0.01 wt % or less or even be free of water. Wt% water is relative to total fluid weight. Water is undesirable if the fluid is used in high temperature applications where water may evaporate out from the fluid.

The fluid can contain or be free of any one or any combination of more than one additive including those selected from a group consisting of antiwear, extreme pressure, corrosion inhibitors, yellow metal passivators, dyes and foam control additives.

Surprisingly, it has been discovered with this invention that inclusion of sulfur in the backbone of a PAG can elevate the fire point of the PAG as determined according to ASTM method D92. It has also been surprisingly discovered with this invention that mixing the S-PAG with an antioxidant results in unexpectedly high thermo-oxidative stability relative to similar compositions without having sulfur in the backbone. The enhanced oxidative stability provides longer lifetime for the fluid without suffering from degradation due to oxidation.

A method for using the fluid of the present invention includes introducing the fluid into an apparatus as a material selected from a group consisting of hydraulic fluid and lubricating fluid.

EXAMPLES

Table 1 identifies materials used in the Examples and Comparative Examples.

TABLE 1

| Component | Description |
|---|---|
| OSP-32 | Dodecanol initiated random copolymer (PO/BO, 50/50 by weight) with a typical kinematic viscosity at 40° C. of 32 $mm^2/s$ (cSt). Its average molecular weight is 760 g/mole and viscosity index is 146. For example, PAG available under tradename UCON ™ OSP-32. (UCON is a trademark of Union Carbide Corp.). |
| OSP-46 | Dodecanol initiated random copolymer (PO/BO, 50/50 by wt) with a typical kinematic viscosity at 40° C. of 46 $mm^2/s$ (cSt). Its average molecular weight is 1000 g/mole and viscosity index is 164. For example, PAG available under tradename UCON ™ OSP-46 |
| OSP-68 | Dodecanol initiated random copolymer (PO/BO, 50/50 by wt) with a typical kinematic viscosity at 40° C. of 68 $mm^2/s$ (cSt). Its average molecular weight is 1300 g/mole and viscosity index is 171. Forexample, PAG available under tradename UCON ™ OSP-68 |
| 100-30B | Polypropylene glycol monobutyl ether with a typical kinematic viscosity at 40° C. of 50 $mm^2/s$ (cSt). Its average molecular weight is 1000 g/mole and viscosity index is 190. For example, the product available under the tradename SYNALOX ™ 100-30B. SYNALOX is a trademark of TheDow Chemical Company. |
| 50-30B | Butanol initiated random copolymer (EO/PO, 50/50 by wt) with a typical kinematic viscosity at 40° C. of 50 $mm^2/s$ (cSt). Its average molecular weight is 1000 g/mole and viscosity index is 211. For example, th eproduct available under the tradename SYNALOX ™ 50-30B. |
| Antioxidant 1 | Anti-oxidant: Octylated/butylated diphenylamine. Commercially available under the tradename IRGANOX ™ L57 or VANLUBE ™ 961. IRGANOX is a trademark of BASF SE Company. VANLUBE is a trademark of R.T. Vanderbilt Company. |
| Antioxidant 2 | Anti-oxidant: Alkylated, phenyl-alpha-naphthylamine. Commercially available under the tradename IRGANOX ™ L06. |
| Antioxidant 3 | Phenothiazine. |
| Antioxidant 4 | Anti-oxidant: p,p'-dioctyldiphenylamine Commercially available under the tradename VANLUBE ™ 81. |
| Antioxidant 5 | Anti-oxidant: methylene bis (dibutyldithiocarbamate). Commercially available under the tradename VANLUBE 996E. |

Synthesis of S-PAG1 :Propylene Oxide Homopolymer of 2,2'-thiodiethanol

Load 1190 grams (g) of 2,2'-thiodiethanol into a stainless steel alkoxylation reactor equipped with a stirrer, an alkylene oxide dosing system, a temperature control system and a means to apply vacuum. Add 26.5 g of a 45 wt % aqueous potassium hydroxide solution as a catalyst. Close the reactor and replace air in the reactor with nitrogen. Heat the reactor to 115 degrees Celsius (° C.) and remove water by applying vacuum at 30 millibar for 120 minutes to reduce the concentration of water to less than 3000 weight-parts per million by weight of total contents weight (ppm). Further heat the reactor to 130° C. and add 4750 g propylene oxide over 6 hours. Once all propylene oxide has been added, stop the propylene oxide feed and maintain the reactor at 130° C. for six hours to allow remaining oxide to react. Treat the resulting polyglycol with magnesium silicate and filter to remove catalyst. The product (S-PAG1) has a kinematic viscosity at 40° C. of 45.8 centistokes (cSt), at 100° C. of 6.96 cSt, a viscosity index of 109 and a hydroxyl number of 188.0 milligrams potassium hydroxide per gram.

S-PAG1 has a structure of that of Structure (I) where R1, R2, R3 and R4 are each methyl, R5 is hydrogen and, on average, the sum of m, m', n and n' is 8.4.

Synthesis of S-PAG2: Butylene Oxide Homopolymer of 2,2'-thiodiethanol

Load 582 g of 2,2'-thiodiethanol into a stainless steel alkoxylation reactor equipped with a stirrer, an alkylene oxide dosing system, a temperature control system and a means to apply vacuum. Add 13.9 g of a 45 wt % aqueous potassium hydroxide solution as a catalyst. Close the reactor and replace air in the reactor with nitrogen. Heat the reactor to 115° C. and remove water by applying vacuum at 30 millibar for 120 minutes to reduce the concentration of water to less than 3000 ppm. Further heat the reactor to 130° C. and add 2514 g 1,2-butylene oxide over 6 hours. Once all 1,2-butylene oxide has been added, stop the 1,2-butylene oxide feed and maintain the reactor at 130° C. for six hours to allow remaining oxide to react. Treat the resulting polyglycol with magnesium silicate and filter to remove catalyst. The product (S-PAG2) has a kinematic viscosity at 40° C. of 50.7 cSt, at 100° C. of 6.80 cSt, a viscosity index of 84 and a hydroxyl number of 179.0 milligrams potassium hydroxide per gram.

S-PAG2 has a structure of that of Structure (I) where R1, R2, R3 and R4 are each ethyl, R5 is hydrogen and on average, the sum of m, m', n and n' is 7.3.

Synthesis of S-PAG3: Propylene Oxide/Butylene Oxide Random Copolymer of 2,2'-thiodiethanol Load 600 g of 2,2'-thiodiethanol into a stainless steel alkoxylation reactor equipped with a stirrer, an alkylene oxide dosing system, a temperature control system and a means to apply vacuum. Add 14.2 g of a 45 wt % aqueous potassium hydroxide solution as a catalyst.

Close the reactor and replace air in the reactor with nitrogen. Heat the reactor to 115° C. and remove water by applying vacuum at 30 millibar for 120 minutes to reduce the concentration of water to less than 3000 ppm. Further heat the reactor to 130° C. and add 2590 g of a 50/50 mixture (by weight 0 of propylene oxide and 1,2 butylene oxide over 6 hours. Once all alkylene oxide has been added, stop the alkylene oxide feed and maintain the reactor at 130° C. for six hours to allow remaining oxide to react. Treat the resulting polyglycol with magnesium silicate and filter to remove catalyst. The product (S-PAG3) has a kinematic viscosity at 40° C. of 48.7 cSt, at 100° C. of 7.05 cSt, a viscosity index of 101 and a hydroxyl number of 179.0 milligrams potassium hydroxide per gram.

S-PAG3 has a structure of that of Structure (I) where R1 and R2 are methyl, R3 and R4 are ethyl, on average m+m' is 4.5, n+n' is 3.7.

Comparative Examples (Comp Exs) A-H: Fire Point Characterization of Base Oils Characterize the fire point, according to ASTM method D92, of the base oils identified in Table 2. These values serve as reference values for fluid formulations.

TABLE 2

| Sample | Base Oil | Fire Point (° C.) |
|---|---|---|
| Comp Ex A | 50-30B | 245 |
| Comp Ex B | 100-30B | 244 |
| Comp Ex C | OSP-32 | 240 |
| Comp Ex D | OSP-46 | 254 |
| Comp Ex E | OSP-68 | 242 |
| Comp Ex F | S-PAG1 | 284 |
| Comp Ex G | S-PAG2 | 276 |
| Comp Ex H | S-PAG3 | 278 |

Comp Exs I-M and Examples (Exs) 1-4: Fire Point Values for Fluids with Antioxidant Prepare fluids consisting of a base oil and antioxidant as described in Table 3. Wt% is based on total fluid weight. Characterize the fire point for the resulting fluids according to ASTM method D92. Results are in Table 3.

TABLE 3

| Sample | Fluid Description | Fire Point (° C.) |
|---|---|---|
| Comp Ex I | OSP-46 + 1 wt % Antioxidant 1 | 286 |
| Comp Ex J | OSP-46 + 1 wt % Antioxidant 5 | 272 |
| Comp Ex K | OSP-46 + 1 wt % Antioxidant 2 | 290 |
| Comp Ex L | OSP-46 + 1 wt % Antioxidant 4 | 283 |
| Comp Ex M | OSP-46 + 1 wt % Antioxidant 3 | 302 |
| Ex 1 | S-PAG1 + 1 wt % Antioxidant 1 | 305 |
| Ex 2 | S-PAG1 + 1 wt % Antioxidant 2 | 297 |
| Ex 3 | S-PAG1 + 1 wt % Antioxidant 3 | 297 |
| Ex 4 | S-PAG1 + 1 wt % Antioxidant 1 + 1 wt % Antioxidant 2 | 305 |

The data in Table 3 reveals that addition of antioxidant tends to increase the fire point of a base oil. However, compared with the data in Table 1, it is evident that S-PAG fluids depend less on the antioxidant to achieve fire point above 275° C. than PAG base oils that do not include sulfur. Therefore, the Examples of the present invention will sustain a higher fire point over the lifetime of the fluid even as antioxidant is consumed.

Comp Ex N and Exs 5-7 Oxidative Stability of Fluids

Characterize the oxidative stability of the fluids identified in Table 4 using a modified ASTM D-2893B test. Place 300 milliliters of the base oil in a borosilicate glass tube and heat to 121° C. under a dry air flow (10 liters per hour flow rate) for 28 days using the equipment described in ASTM D2893. Measure the total acid number (TAN) according to ASTM D664 both initially before heating and after 28 days at the 121° C. The change in TAN value between these two measurements determines whether a fluid passes or fails the oxidative stability test. A small change in TAN value corresponds to higher oxidative stability than a large change in TAN value. Fluids that demonstrate a TAN increase of less than 2.0 mgKOH/g "PASS" and those demonstrating a TAN increase of more than 2.0 mgKOH/g "FAIL" the test.

TABLE 4

| Sample | Fluid Description | Initial TAN (mgKOH/g) | 28 Day TAN (mgKOH/g) | PASS/FAIL |
|---|---|---|---|---|
| Ex 5 | S-PAG1 + 0.5 wt % Antioxidant 1 | 0.05 | 0.59 | PASS |

TABLE 4-continued

| Sample | Fluid Description | Initial TAN (mgKOH/g) | 28 Day TAN (mgKOH/g) | PASS/ FAIL |
|---|---|---|---|---|
| Ex 6 | S-PAG2 + 0.5 wt % Antioxidant 1 | 0.05 | 0.46 | PASS |
| Ex 7 | S-PAG3 + 0.5 wt % Antioxidant 1 | 0.05 | 0.88 | PASS |
| Comp Ex N | OSP-46 + 0.5 wt % Antioxidant 1 | 0.04 | 7.84 | FAIL |
| Comp Ex O | OSP-46 + 1 wt % Antioxidant 1 | 0.05 | 9.0 | FAIL |
| Comp Ex P | OSP-68 + 1 wt % Antioxidant 1 | 0.09 | 6.90 | FAIL |
| Comp Ex Q | 50-30B + 1 wt % Antioxidant 1 | 0.05 | 6.0 (after 7 days) | FAIL |
| Comp Ex R | 100-30B + 1 wt % Antioxidant 1 | 0.04 | 8.7 (after 20 days) | FAIL |

The data in Table 4 reveals a synergistically enhanced oxidative stability of the S-PAG material in combination with antioxidant. At a 0.5 wt % loading of antioxidant, the fluids with S-PAG base oil easily pass the oxidative stability test while the other base oils unquestionably fail the oxidative stability test even with twice as much antioxidant.

What is claimed is:

1. A fluid comprising a base oil and an antioxidant, the base oil consisting of a sulfur-containing polyalkylene glycol selected from a group consisting of polyalkylene glycols having the following formula:

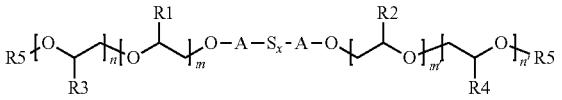

where R1, R2, R3 and R4 are independently selected from a group consisting of —$CH_3$ and —$CH_2CH_3$ groups; x is a number selected from a group consisting of 1 and 2; m, m', n, and n' are independently selected from integers in a range of zero to twenty such that the sum of m, m', n and n' is at least six and A is selected from a group consisting of —$C_2H_4$— and $C_6H_4$ groups, where greater than 80 weight-percent of the fluid is a sulfur-containing polyalkylene glycol and less than one weight-percent of the fluid is water, with weight percent based on total fluid weight and wherein the sulfur-containing polyalkylene glycol is free of oxygen bound directly to sulfur.

2. The fluid of claim 1, wherein xis 1 and A is —$C_2H_4$—.

3. The fluid of claim 1, wherein R1, R2, R3 and R4 are all —$CH_3$ groups.

4. The fluid of claim 1, wherein the fluid comprises greater than 90 weight-percent of the sulfur-containing polyalkylene glycol based on total fluid weight.

5. The fluid of claim 1, wherein the antioxidant is selected from alkylated diphenylamines.

6. The fluid of claim 1, wherein the antioxidant is octylated/butylated diphenylamine.

7. The fluid of claim 1, wherein the fluid is free of polyalkylene glycol having —$C_2H_4O$— groups that are not bound directly to sulfur.

8. A method for using the fluid of claim 1, the method comprising introducing the fluid into an apparatus as a material selected from a group consisting of hydraulic fluid and lubricating fluid.

* * * * *